US005301849A

United States Patent [19]

Guglielmini et al.

[11] Patent Number: 5,301,849

[45] Date of Patent: Apr. 12, 1994

[54] SPOUT ASSEMBLY AND SEALING CAP WITH SPRING-LOADED HINGE

[75] Inventors: Bernard Guglielmini, Crimolois; Pierre Pellerano, Paris, both of France

[73] Assignee: Rical S.A., Longvic, France

[21] Appl. No.: 777,240

[22] PCT Filed: May 17, 1990

[86] PCT No.: PCT/FR90/00346

§ 371 Date: Nov. 12, 1991

§ 102(e) Date: Nov. 12, 1991

[87] PCT Pub. No.: WO90/14287

PCT Pub. Date: Nov. 29, 1990

[30] Foreign Application Priority Data

May 17, 1989 [FR] France ..... 89 06433

[51] Int. Cl.[5] ..... B67D 3/00

[52] U.S. Cl. ..... 222/517; 222/541; 222/556

[58] Field of Search ..... 222/92, 511, 517, 541, 222/556; 264/259

[56] References Cited

U.S. PATENT DOCUMENTS

| | | | |
|---|---|---|---|
| 3,135,441 | 6/1964 | Wise et al. | 222/541 |
| 3,160,327 | 12/1964 | Porcelli | 222/541 X |
| 3,458,080 | 7/1969 | Laurizio | 222/541 X |
| 4,022,357 | 10/1977 | Dwinell | 222/541 X |
| 4,568,005 | 2/1986 | Julovec et al. | 222/517 X |

FOREIGN PATENT DOCUMENTS

| | | | |
|---|---|---|---|
| 0172711 | 2/1986 | European Pat. Off. . | |
| 0306381 | 3/1989 | European Pat. Off. . | |
| 1402900 | 5/1965 | France . | |
| 2380195 | 5/1984 | France . | |
| 0021275 | 2/1978 | Japan | 264/259 |
| 0049971 | 12/1980 | Japan | 264/259 |
| 6508156 | 6/1965 | Netherlands | 222/541 |
| 1074073 | 6/1967 | United Kingdom . | |
| 2193193 | 2/1988 | United Kingdom . | |

*Primary Examiner*—Andres Kashnikow
*Assistant Examiner*—Joseph A. Kaufman

[57] ABSTRACT

A spout and sealing cap assembly for a container which includes a spout which is connectable to the container, a sealing cap for closing off a dispensing opening in the spout and a bi-stable hinge integrally formed with the sealing cap. The bi-stable hinge maintains the cap only in one of two stable positions, an open position and a closed position. The spout is formed as a first one-piece plastic part with an undercut profile connection portion. The sealing cap is also formed as a second one-piece plastic part with an undercut profile connection portion spaced from the bi-stable hinge. The plastic of the spout is a formed of a more flexible plastic than that of the sealing cap. The bi-stable hinge is formed integrally with the sealing cap and, thus, also is formed of the relatively rigid, hard plastic. The first and second undercut profile connection portions are interconnected in an interconnection arrangement resulting from an over-molding of the second one-piece elastic part over the first one-piece plastic part. In one embodiment, the sealing cap includes an extension extending from the hinge and having a free edge with an undercut for connection with a corresponding extension of the spout.

9 Claims, 3 Drawing Sheets

SPOUT ASSEMBLY AND SEALING CAP WITH SPRING-LOADED HINGE

FIELD OF THE INVENTION

The present invention relates to a dispenser and sealing cap assembly of a plastic material comprising a spout part adapted to be fixed to a container and a sealing cap adapted to close off the spout part and which is connected to the spout part by a spring hinge.

BACKGROUND OF THE INVENTION

Until now such dispenser and sealing cap assemblies were made as one single part by moulding of a rigid plastic material such as polypropylene. In fact, the spring hinges provided on such assemblies between the spout part and the sealing cap only correctly fulfill their function, which is to ensure two stable positions of the cap in relation to the dispensing part, when they are made of a rigid plastic material.

Such spring hinges are known, for example, from the French Patent Nos. 1 402 900 and 78 03 713.

On the known spout and sealing cap assemblies made as one single part with the spring hinge from a rigid plastic material, the tightness between the spout part and the neck of the container must be ensured by means moulded onto the dispensing part, in particular by lips and/or skirts cooperating with the neck of the container. Because of the rigidity of the material of which they are made, these sealing means are unable to compensate possible defects of the neck, which adversely affects the tightness. The use of separate flexible seals on the spout part which would permit a compensating of such defects is not always possible and would increase the cost price of the spout and cap assembly.

Another problem is experienced with the dispenser and sealing cap assemblies provided for flexible tubes containing pasty materials, e.g. toothpaste tubes. Nowadays, these tubes are made more and more from a flexible plastic material, in particular polyethylene or from a complex or multilayer structure having an outside polyethylene film. Under these conditions, a spout and sealing cap assembly, made as one single part from a rigid plastic material such as polypropylene so as to enable the spring hinge provided between the two parts to fulfill its function, cannot be welded directly onto the flexible tube. Rather, this type of assembly must be screwed onto a threaded neck end of a flexible plastic material, in particular polyethylene, welded onto the actual body of the flexible tube. It would be desirable to be able to make spout and sealing cap assemblies with spring hinge which can be fixed directly by welding onto the body of flexible tubes.

SUMMARY OF THE INVENTION

The present invention seeks to provide a spout and sealing cap assembly with spring hinge which, while being easy to make, permits a tight fixing onto a container neck even if the neck has manufacturing defects. A further object of the invention is a spout and sealing cap assembly with spring hinge which, while being easy to make, permits the assembly to be fixed by welding it directly onto the body of a flexible tube.

The spout and sealing cap assembly according to the invention comprises a spout part adapted to be fixed to a container and a sealing cap adapted to seal off the spout part and connected to the spout part by a spring hinge. According to the invention the spout part is made from a flexible plastic material, by moulding, and the cap with the hinge is made as one single part from a rigid plastic material by over-moulding the dispensing part.

Making the spout part from a flexible plastic material permits either the forming onto the spout part of sealing means (lips, skirts, etc.) which are sufficiently flexible so that they can compensate possible manufacturing defects of the container neck when the spout part is screwed or clicked onto the neck, or a direct fixing by welding the spout part onto the body of a flexible tube.

The over-moulding of the spout part by the cap can be localized in the zone of the hinge, in which case the spout part has advantageously, in the zone of the hinge, an edge with a male or female undercut profile ensuring a perfect bonding with the material of the cap and the hinge during the over-moulding.

According to another embodiment the over-moulding of the spout part by the cap can take place all around the periphery by over-moulding the spout part with a circumferential band to which the actual cap is connected by the spring hinge.

BRIEF DESCRIPTION OF THE PREFERRED EMBODIMENTS

Other features and advantages of the invention will become apparent when reading the following description of several exemplified and non-limitative embodiments of the invention illustrated on the attached drawings, wherein.

DETAILED DESCRIPTION OF THE PREFERRED EMBODIMENTS

Figure 1:
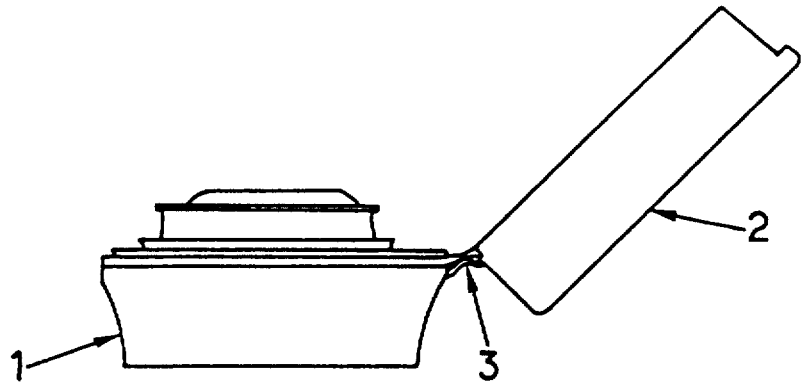
FIG. 1 is a side view of a spout and sealing cap assembly according to the invention, the cap being shown in the open position.
Figure 2:
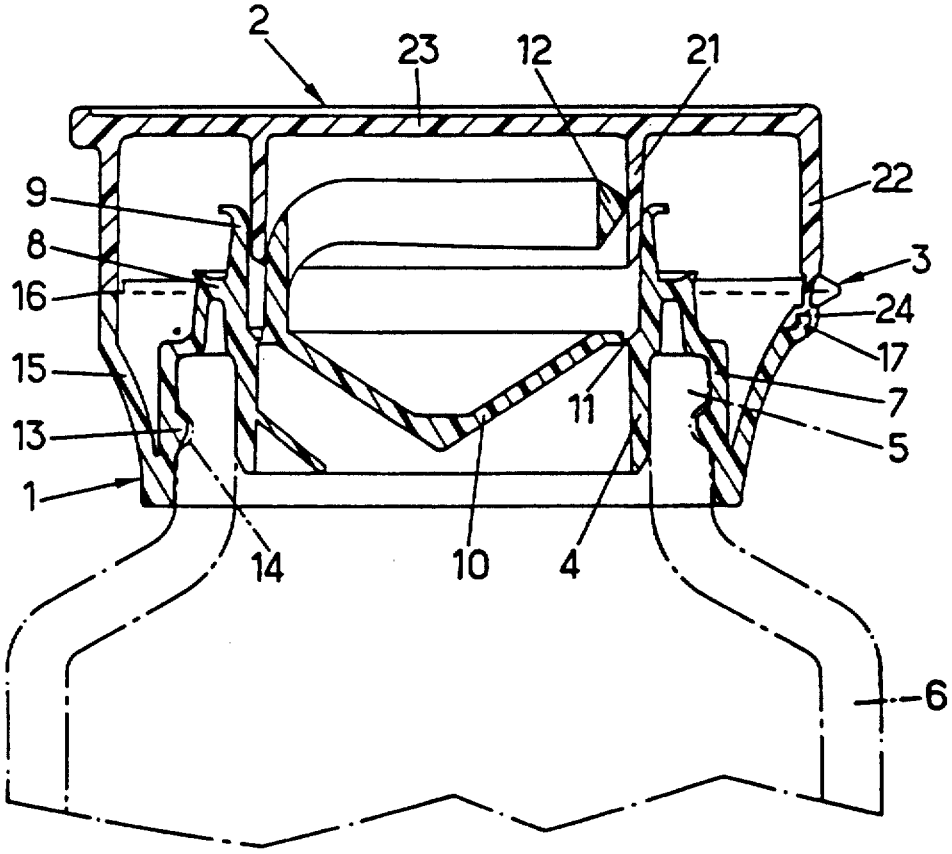
FIG. 2 is a vertical cross-section on a larger scale of the assembly of FIG. 1, the cap being closed.

The plastic spout and sealing cap assembly according to FIGS. 1 and 2 comprises a spout part 1 and sealing cap 2 connected to the spout part 1 by a spring hinge 3.

As can be noted from FIG. 2, the spout part 1 comprises essentially an inside skirt 4 adapted to cooperate in a tight manner with the inner surface of the neck 5 of a bottle 6, and an outside skirt 7 adapted to cooperate with the outer surface of the neck 5, both skirts 4 and 7 being connected to one another at the top by an annular connecting zone 8. The inside skirt 4 extends upwards from the connecting zone 8 in the form of a dispensing spout 9. A lid 10 connected by a thin skin 11 to the inside skirt 4 closes this skirt off. The cover 10 can be pulled out with the aid of a pulling ring 12 when using the container for the first time.

The outside skirt 7, which has an inside rib 13 for fixing the spout part 1 onto the container by clicking it onto the neck 5 provided with an outside groove 14, is connected at its bottom end to an outer flange 15 which extends upwards in the form of a diverging annular wall up to the contact plane 16 between the spout part 1 and the cap 2, except in the zone of the spring hinge 3. In this zone the flange 15 ends below the hinge 3 in an edge 17 shaped like an undercut, e.g. a dovetailed tenon. Hinge 3 is shown in FIG. 2 to include a flexible intermediate member extending between the thicker skirt 22 and connecting part 24.

The complete spout part as described above is made as one single part by injection moulding from a flexible plastic material, e.g. polyethylene.

The sealing cap 2 comprises an inside skirt 21 and an outside skirt 22 extending downwards from a cap top 23, the inside skirt 21 being adapted to fit into the dispensing spout 9 and the outside skirt 22 forming an extension of the flange 15 of the spout part 1. The cap 2 is injection moulded from a rigid plastic material such as polypropylene, as one part together with the spring hinge 3 and, between the latter and the edge 17 of the spout part 1, with a connecting part 24 which has a female profile in the shape of an undercut, e.g. dovetailed mortice. The cap 2 is made by over-moulding the spout part 1, i.e. first the spout part 1 is made by injection moulding in a first mould; it is then taken out of this first mould and placed as an insert in a second mould in which the cap 2, together with the hinge 3 and the connecting part 24, is made by over-moulding the spout part 1 with the cap 2 in the open position as shown in FIG. 1. The over-moulding is localized in the zone of the hinge, i.e. limited to over-moulding the edge 17 of the spout part 1 by the connecting part 24 situated underneath the hinge 3.

Figure 3:
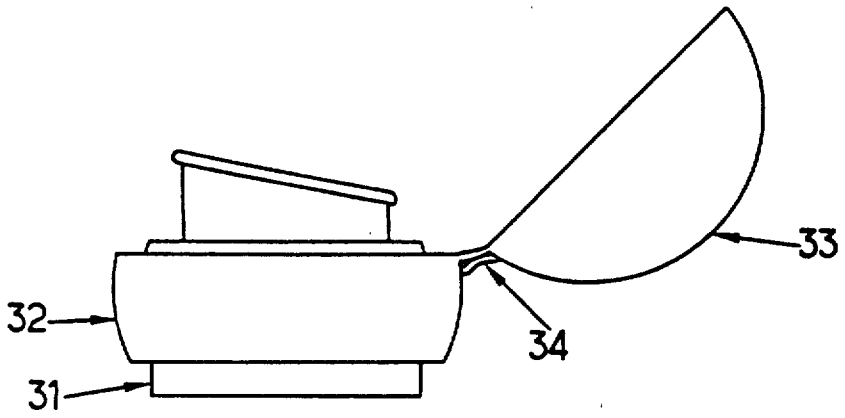
FIG. 3 is a side view similar to FIG. 1 of another embodiment of an assembly according to the invention.
Figure 4:
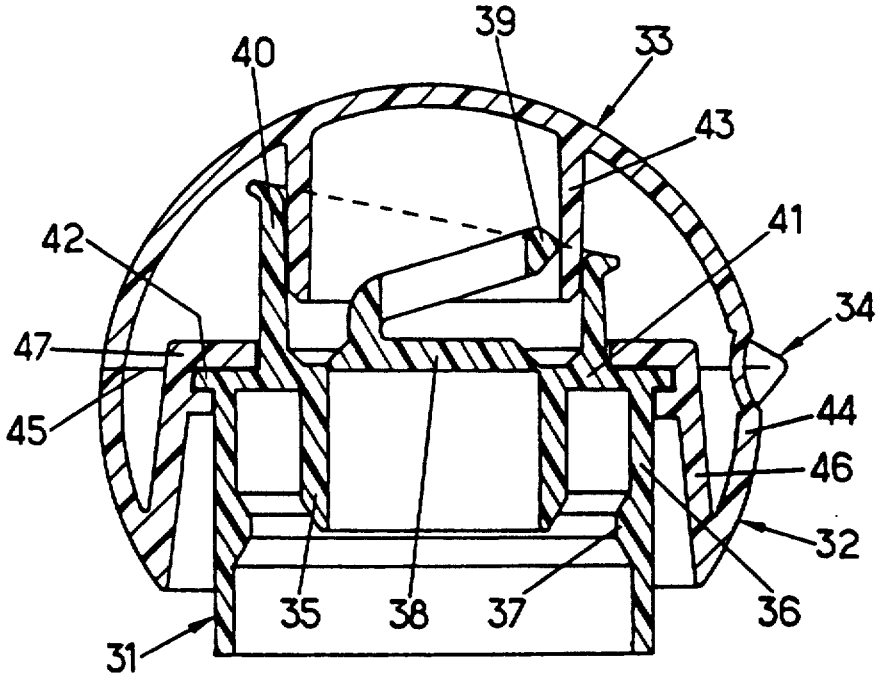
FIG. 4 is a vertical cross-section on a larger scale of the assembly of FIG. 3.

According to FIGS. 3 and 4, a spout and sealing cap assembly comprises a spout part 31, an annular wall 32, a sealing cap 33 and a hinge spring 34.

The spout part 31 has an inside skirt 35 adapted to cooperate with the inner surface of a not illustrated bottle neck, an outside skirt 36 adapted to cooperate with the outer surface of the neck and provided with an inside rib 37 adapted to cooperate by clicking with an outside groove of the neck, a cover 38 with pulling ring 39, and a dispensing spout 40 extending upwards from the connecting part 41 of the two skirts 35 and 36. It must be noted that the connecting part 41 has an outer rim 42 which projects radially around the entire periphery.

The sealing cap 33, which has a hemispherical shape and is provided with an inside skirt 43 adapted to cooperate with the dispensing spout 40, is connected by the spring hinge 34 to annular wall 32 which ensures its connection to the spout part 31. The annular wall 32 comprises an outer part 44 in the form of a spherical crown, which extends from the hemispherical cap 33 to below the contact plane 45 between the band 32 and the cap 33, and an inside truncated cone shaped part 46 extending from the inside end of the part 44 upwards and inwards to end in an annular part 47 which encircles on the outside, over the entire periphery, the rim 42 of the spout park, 31 and has a female profile complementary to the profile of the rim 42.

To make the assembly illustrated in FIGS. 3 and 4, first of all the spout part 31 is injection moulded in a first mould from a flexible plastic material such as polyethylene. Then the spout part 31 is placed in a second mould in which the spout part 31 is over-moulded with the aid of the annular wall 32 and the cap 33, the latter is in the open position as shown in FIG. 3, by injecting a rigid plastic material such as polypropylene.

Figure 5:
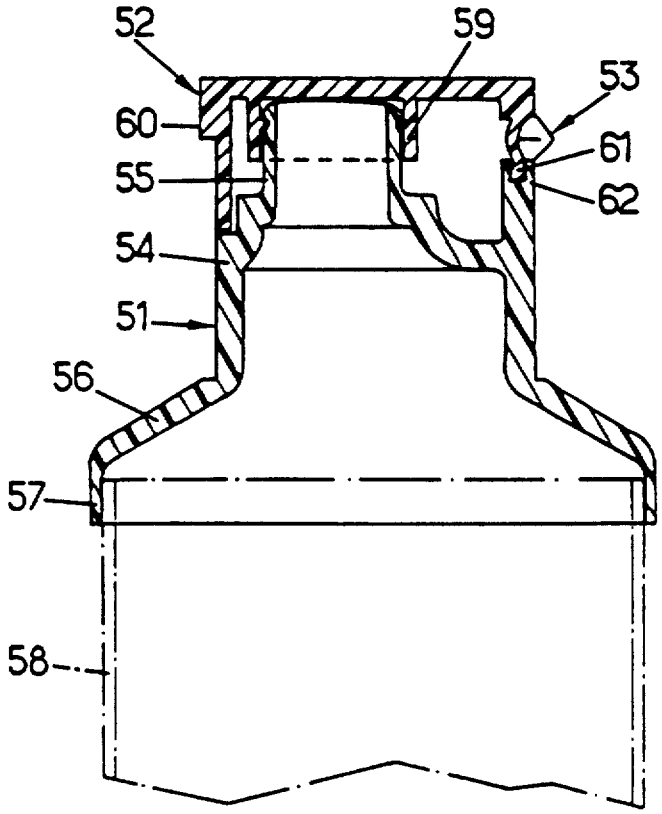
FIG. 5 is a vertical cross-section of a spout and sealing cap assembly for direct fixing by welding onto the body of a flexible tube.

In the embodiment illustrated in FIG. 5, a spout and sealing cap assembly comprises a spout part 51, a sealing cap 52 and a spring hinge 53.

The spout part 51 is formed by a collar 54 which extends upwards into a dispensing spout 55 and downwards into a diverging collar 56 which ends in a rim 57 for connecting the spout part 51 to a flexible tube 58.

The cap 52 which has a shape similar to that of the cap of FIGS. 1 and 2 has an inside skirt 59 cooperating with the dispensing spout 55 and an outside skirt 60. Below the hinge 53 the outside skirt 60 of the cap 52 is extended downwards by a connecting part 61 which has a male undercut profile, e.g. in the form of a dovetailed tenon, and the spout part 51 has an edge 62 with a complementary profile, e.g. in the form of an undercut dovetail shaped mortice.

Also in this embodiment the spout part 51 as a whole is first made by injection moulding from a flexible plastic material in a first mould, and then is transferred to a second injection moulding mould in which the spout part 51 is over-moulded by the cap by injecting a rigid plastic material.

The spout and sealing cap assembly made in this manner can then be welded directly by way of the rim 57 onto a flexible tube 58 of a flexible plastic material because of the compatibility of the materials of the spout part 51 and the tube 58.

It must be noted that the embodiments described above and illustrated in the attached drawings have been given only by way of non-limitative examples and that numerous modifications and variations are possible with the scope of the invention.

Thus, the spring hinge between the cap and the spout part may be made according to all the known embodiments of such spring hinges.

Inviolability means other than lid (10,38) may be provided, e.g. tear away means covering the provided hollow opposite the spring hinge in the outside skirt of the cap to facilitate the opening of the cap. These are known means which have not been illustrated so as not to complicate the drawings.

Instead of fixing the spout part onto the neck of the bottle by clicking it on as shown in FIGS. 1 to 4, it would be also possible to provide a screw type fixing.

Furthermore, sealing means between the spout part and the bottle neck may be formed by one of several lips or other known means which form an integral part of the spout part, in addition to or in place of the inside skirt (4,35) cooperating with the inner surface of the neck.

Another point of interest of the construction according to the invention of a spout and sealing cap assembly consists in the possibility of making a two-colour assembly, as the different materials used in the manufacture of the assembly according to the invention may have different colours.

We claim:

1. A spout and sealing cap assembly for a container, comprising:

a spout having means for securing said spout to the container;

a sealing cap adapted to close off said spout; and a bi-stable spring hinge integrally formed with said sealing cap, said bi-stable spring hinge being dimensioned and arranged with respect to said spout and sealing cap such that said sealing cap is positionable in one of two positions, the first position being a stable closed position wherein said sealing cap closes off said spout and the second position being a stable, open position wherein said spout is in an open state, said spout being a first one-piece part formed of a flexible plastic material, and said spout having a first undercut profile connection portion, said sealing cap being a second one-piece part formed of a hard plastic material that is more rigid than the plastic material of said spout, said sealing cap having a second undercut profile connection portion adapted for interconnection with said first undercut profile connection portion, said second undercut profile connection portion being spaced from said bi-stable spring hinge which is integrally formed with said sealing cap of the hard plastic material, and said first and second connection portions being interconnected in an interconnection arrangement resulting from an over moulding of said one piece second part over said one-piece first part in a region defined by said first and second undercut profile connection portions such that said spout and sealing cap are interconnected to form said assembly.

2. An assembly as recited in claim 1 wherein said first connection portion includes an upwardly extending flange member having an upper first free edge and said second connection portion includes a downwardly extending extension extending from said bi-stable hinge to a lower, second free edge, and one of said free edges having a female reception portion and another of said free edges having a male portion adapted for interconnection with said female reception portion.

3. An assembly as recited in claim 1 wherein said first and second connection portions comprise a dovetail-shaped tenon and a dovetail-shaped mortise.

4. An assembly as recited in claim 3 wherein said first connection portion includes said dovetail-shaped tenon, and said second connection portion is formed with said dovetail-shaped mortise.

5. An assembly as recited in claim 3 wherein said second connection portion includes said dovetail-shaped tenon, and said first connection portion is formed with said dovetail-shaped mortise.

6. An assembly as recited in claim 1 wherein said first and second connection portions extend over an entire periphery of said spout and said first connection portion includes a radially outwardly projecting member and said second connection portion includes an annular portion connected by said hinge to said sealing cap.

7. An assembly as recited in claim 1 wherein said securing means includes a rim formed of a plastic material directly weldable to a flexible tube forming the container.

8. An assembly as recited in claim 1 wherein said securing means includes an outer skirt on said spout with an inside rib engageable with a neck portion of the container by snap-engagement of said inside rib with an outside groove on the neck portion of the container.

9. An assembly as recited in claim 1 wherein said bi-stable hinge includes a flexible intermediate member formed of the same material as said sealing cap and having less thickness than a skirt portion of said sealing cap integrally connected with said intermediate member and less thickness than a section of said second undercut connection profile portion integrally connected with said intermediate member.

* * * * *